United States Patent [19]

Van Horn

[11] 4,342,215

[45] Aug. 3, 1982

[54] NAIL MACHINE WIRE FEED MECHANISM

[75] Inventor: Ronald L. Van Horn, Pittsburg, Ca.

[73] Assignee: United States Steel Corporation, Pittsburgh, Calif.

[21] Appl. No.: 195,588

[22] Filed: Oct. 9, 1980

Related U.S. Application Data

[63] Continuation-in-part of Ser. No. 17,296, Mar. 5, 1979, abandoned.

[51] Int. Cl.[3] ..... B21G 3/20; B21D 43/10

[52] U.S. Cl. ..... 72/422; 10/43

[58] Field of Search ..... 10/43, 49, 50, 51, 53, 10/54; 72/419, 422; 226/137, 139, 158, 161, 162, 165, 167

[56] References Cited

U.S. PATENT DOCUMENTS

| | | | |
|---|---|---|---|
| 1,685,439 | 9/1928 | Strout | 10/49 |
| 1,701,098 | 2/1929 | Brown | 10/43 |
| 2,315,108 | 3/1943 | Chism | 226/167 |
| 2,767,411 | 10/1956 | Clary et al. | 10/49 |
| 2,800,997 | 7/1957 | Friedman | 10/49 |
| 2,823,792 | 2/1958 | Lord | 226/165 |
| 2,829,388 | 4/1958 | Dzama | 10/54 |
| 3,123,846 | 3/1964 | Prutton | 10/43 |
| 3,362,035 | 1/1968 | Faulkner | 10/43 |

FOREIGN PATENT DOCUMENTS

| | | | |
|---|---|---|---|
| 592128 | 2/1934 | Fed. Rep. of Germany | 226/162 |

*Primary Examiner*—Ervin M. Combs

*Attorney, Agent, or Firm*—John F. Carney; George D. Dickos

[57] ABSTRACT

A wire feed mechanism for use in conjunction with a nail forming machine. The wire feed includes a wire clamping device connected through appropriate linkages to a reciprocating hammerslide located within the nail machine. The hammerslide is movable between extended and retracted positions for forming the nail head. Due to the direct positive linkage between the hammerslide and the wire clamping device, feeding movement of the wire into the nail machine is achieved as a direct result of hammerslide movement, thereby obviating the need for cumbersome and elaborate linkages currently in use.

4 Claims, 4 Drawing Figures

NAIL MACHINE WIRE FEED MECHANISM

RELATED APPLICATIONS

This application is a continuation-in-part of U.S. Patent Application Ser. No. 017,296, filed Mar. 5, 1979, now abandoned.

BACKGROUND OF THE INVENTION

In a large percentage of forming machines currently employed in the manufacture of nails, wire is first straightened through a series of rollers and is then incrementally fed into the machine for subsequent nail forming. The wire to be formed in the machine is passed through a sliding platform on which are mounted straightening rolls and some type of wire gripping apparatus. During the nail forming sequence, the sliding platform is moved out from the machine a distance equal to the length of the nail to be formed. This movement permits the straightening rolls to work on the wire. When the platform reaches the end of its outward travel and begins to move inwardly, the wire gripping apparatus is wedged against the wire and establishes a feed of wire into the nail forming machine. The movement of the sliding platform is sequenced through mechanical linkages which connect the rotating end of the machine's main crankshaft to the platform.

The mechanical linkages between the sliding wire feed platform and its crankshaft include two links and four pivot points. Wear at these pivot points makes it difficult not only to set up the nail machine initially for production, but also makes it difficult to maintain consistent repeatability in the length of nails produced. Additionally, the inertial forces transmitted to the end of the crankshaft as the linkage operates causes severe problems in the area of crankshaft alignment and fracture. On the average, applicant has found that linkage and/or crankshaft components of the nail machine require replacement every two hundred (200) hours of operation.

SUMMARY OF THE INVENTION

The present invention is addressed to a wire feed mechanism for use in conjunction with a nail forming machine. The wire feed mechanism is configured having a direct connection with the reciprocating hammerslide of the nail forming machine which is used for forming the head of the nail. The hammerslide is movable between a retracted position (in which it is farthest away from its head forming position) and an extended position (in which it is at its nail head forming location). Consequently, due to the connection between the wire feed mechanism and the hammerslide, there is a direct relationship established between hammerslide movement and wire feeding. This relationship obviates the need for cumbersome and wear prone linkages previously employed in such machines.

The wire feed mechanism includes a selectively operable gripper assembly and an apparatus cooperatively associated with the assembly for adjusting the length of wire gripped and subsequently fed into the nail forming machine. The gripper assembly is attached to one end of the linkage with the hammerslide and thus, is movable with the hammerslide for sequentially feeding wire into the machine. The apparatus for adjusting the length of wire gripped and fed into the nail forming machine by the gripper apparatus is operative to move the gripper apparatus out of engagement with the wire for a given distance of its travel for selectively decreasing the distance the gripper apparatus is in gripping engagement with the wire from the total stroke length of the gripper apparatus. Hence, through the use of the present wire feed mechanism, a simple and easily maintainable wire feed assembly is attained.

Accordingly, it is a general object and feature of the present invention to provide an apparatus for feeding wire into a nail forming machine of the variety having a reciprocating hammerslide, the wire feed mechanism being configured having an actuating linkage provided between the hammerslide and the remainder of the wire feed mechanism.

It is another general object and feature of the present invention to provide an apparatus for feeding wire into a nail forming machine for the type having a reciprocating hammerslide, the wire feed mechanism including a linkage with the hammerslide for selectively actuating the gripping portion of the wire feed mechanism and providing an easily set-up and efficient wire feed mechanism.

It is yet another object and feature of the present invention to provide a wire feed mechanism having an easily set, accurate and efficiently repeatable wire length adjustment mechanism for controlling the length of wire to be fed into the nail forming machine.

Other objects and features of the present invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment of the present invention when read in conjunction with the accompanying drawings wherein:

DETAILED DESCRIPTION OF THE INVENTION

Figure 1:
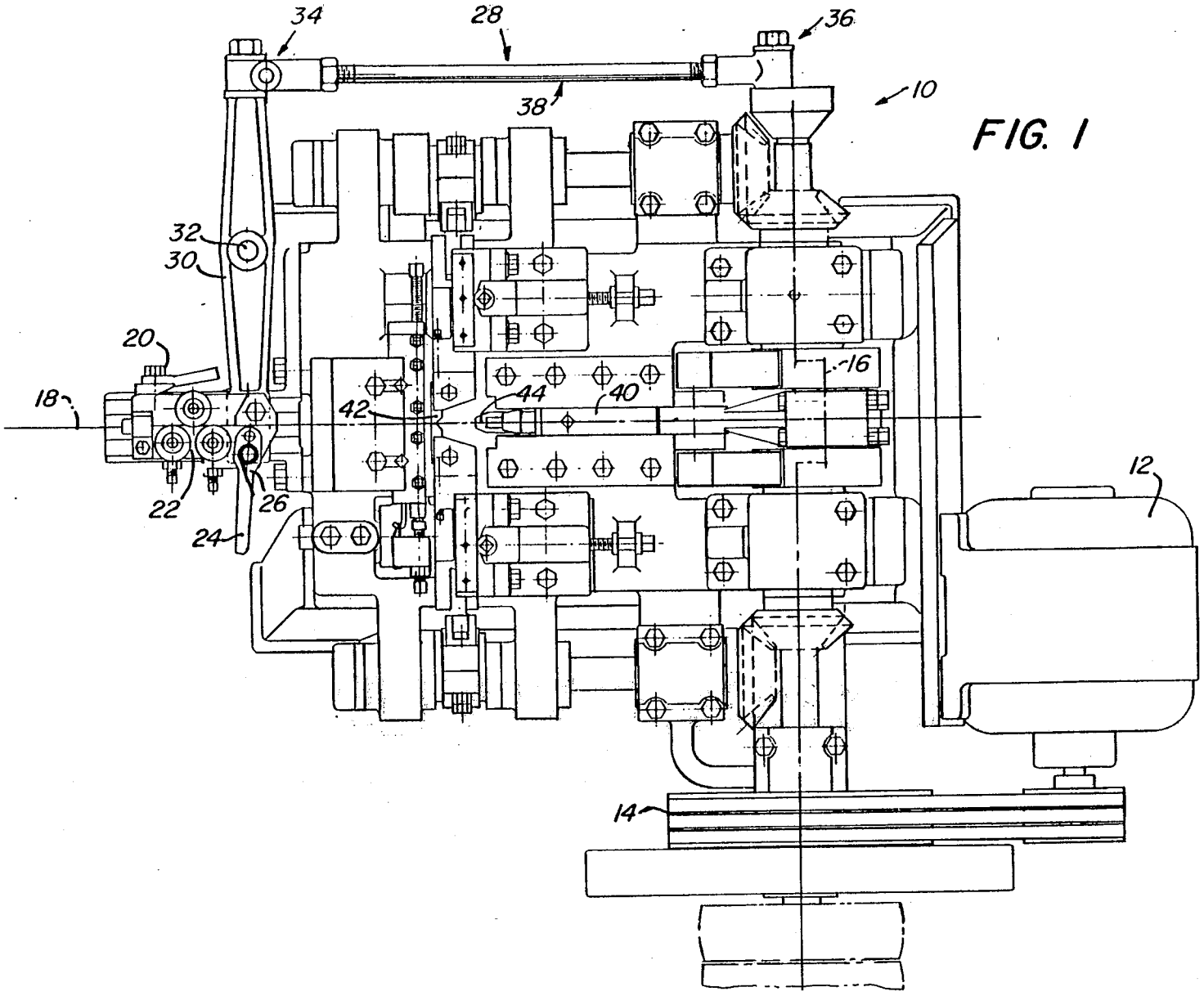
FIG. 1 is a plan view of a typical type of nail machine with which the present invention is associated, but which indicates the usual type of wire feeding mechanism.

Looking to FIG. 1, there is shown a typical nail forming machine 10. The nail machine 10 is of known design and operation and will be described herein only insofar as the specific components of the machine relate to the present invention.

A motor 12 provides, through appropriate beltings 14, the necessary driving energy for the nail forming machine 10. The nail forming machine 10 has a main crankshaft indicated at 16 through which power is passed to the various moving components of the machine as well as for sequentially advancing wire, indicated at 18, into the machine 10. Located on the wire feed side of the nail forming machine 10 is a sliding wire feed platform 20. This sliding wire feed platform is composed of a wire straightener mechanism 22 and a roller feed arrangement 24. Wire to be formed in the machine passes through the sliding platform 20 upon which are mounted the straightening rolls 22 and the roller feed arrangement including a spring loaded wire grip cam 26. During the nail forming sequence, this sliding platform 20 is moved out from the machine a distance equal to the length of the nail being formed. This movement permits the straightening rolls to work on the wire. When the platform 20 reaches the end of its outward travel and begins to move inwardly again, the spring loaded wire grip cam 26 wedges against the wire and establishes a feed of wire into the machine.

The movement of the sliding platform is sequenced through a mechanical linkage assembly indicated generally at 28 which connects the wire forming machine's main crankshaft 16 to the sliding platform 20. The mechanical linkage assembly 28 includes a pivotal arm 30 pivotally movable about a pivot point 32, linkage points 34 and 36, and a linkage arm 38. Due to an offset of the linkage point 36 from the axis of the main crankshaft 16 it can be seen that a reciprocating movement of the arm 30 is made resulting in movement of the sliding platform between its previously mentioned outward and inward positions.

The linkage between the sliding wire feed platform 20 and the crankshaft 16 is comprised of two links and four pivot points. Wear at these pivot points makes it difficult to not only set up the machine initially for production, but also to maintain repeatability in the length of nails produced. The inertial forces transmitted to the end of the crankshaft as the linkage operates causes severe crankshaft alignment and fracture problems. Applicant has found that the linkage and/or crankshaft components of the machine require replacement approximately every two hundred (200) hours of operation. It is obvious that the linkage provided between the main crankshaft through the two linkage arms 30 and 38, as well as the four pivot points for sequentially advancing incremental portions of a wire into a nail forming machine, are cumbersome, complicated and require frequent maintenance.

Figure 2:
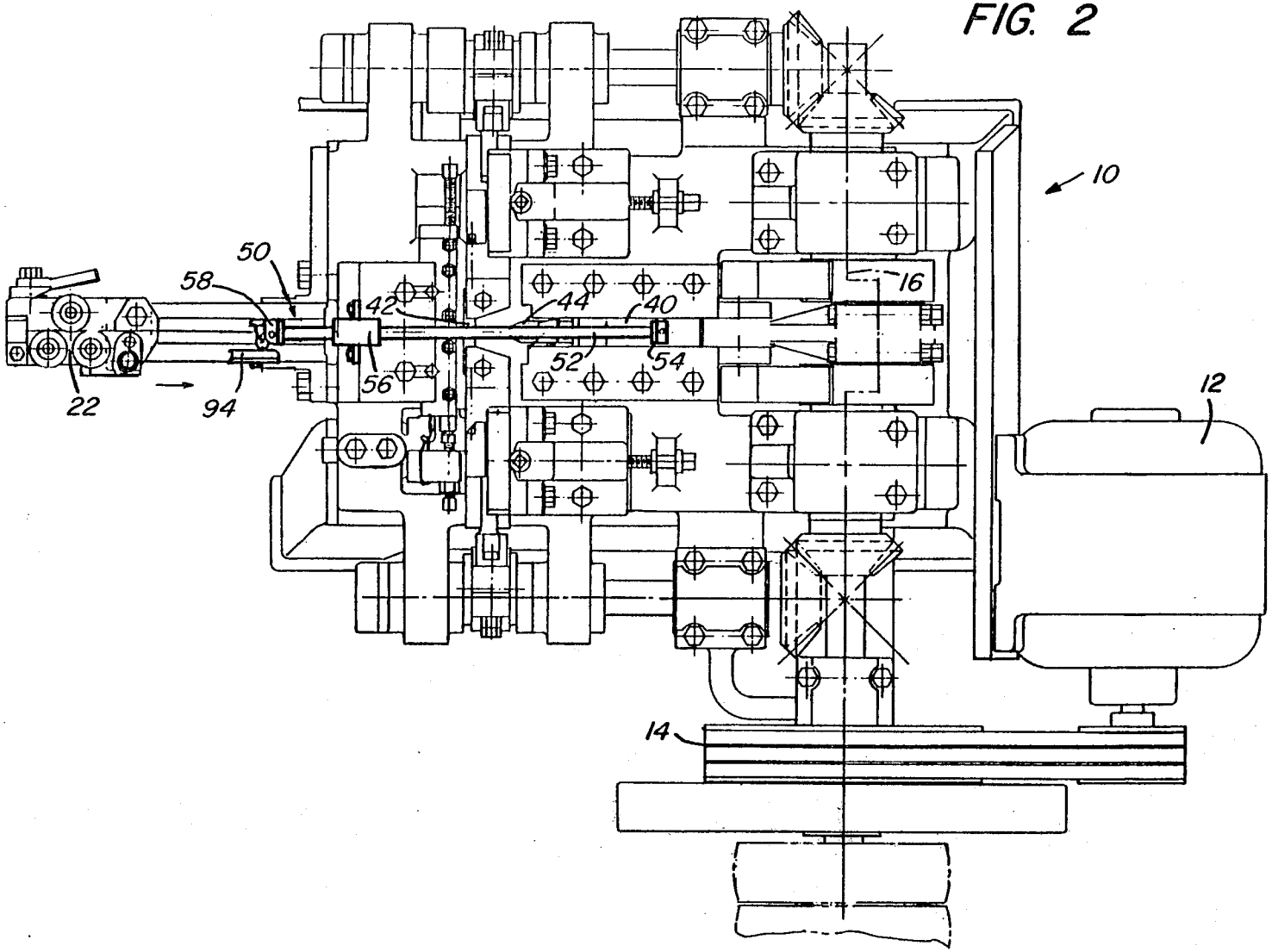
FIG. 2 is a plan view of the nail machine of FIG. 1 with appropriate modifications showing the wire feed mechanism of the present invention combined therewith.

The present invention utilizes the reciprocating movement of a hammerslide element 40 located in the center of the nail forming machine 10 to implement wire feed to the forming die 42 therein. The hammerslide 40 is driven (through appropriate linkage arrangements) by the main crankshaft 16 both toward and away from a nail head forming die 42. The operation of a hammerslide and associated die is not novel and need not be further described herein. The hammerslide 40 is movable from a retracted position as shown in FIGS. 1 and 2 to an extended position in which a front portion 44 thereof is moved into a butting engagement with the nail head forming die 42. It is the reciprocating movement of the hammerslide between its two positions which forms the operational basis of the present wire feed mechanism.

The wire feed device of the present invention is shown generally at 50. A connecting rod 52 is attached at one end to the hammerslide 40 through appropriate connectors indicated generally as 54. The connecting rod 52 is disposed outwardly of the hammerslide 40 to extend longitudinally of the machine and is attached at its other end to the wire feed mechanism described hereinafter. In extending forwardly, the connecting rod 52 passes through, and is slidably supported by, a bushing 56 located at the entrance of the nail forming machine 10. The forward end of the rod 52 is attached to a base 58 of the wire feed mechanism shown in detail in FIGS. 3 and 4. Due to a rigid attachment of the rod 52 with the base 58, there is a resultant reciprocating movement of this member of the wire feed device 50 with the reciprocating movement of the hammerslide 40.

The wire feed device 50 of the present invention is best described with reference to FIGS. 3 and 4. As shown, the device comprises a movable frame 58 formed of an angle member, one arm 60 of which is adapted to weldedly attach the forward end of connecting rod 52 whereby the reciprocating movement of the hammerslide 40 is imparted to the frame. The other arm 62 of the angle member forming the frame 58 rigidly attaches to its back side a block 64 having a surface 66 arranged to be in facing relation to, and closely adjacent, the path along which the wire 18 is adapted to travel in being fed from the straightener 22 to the forming die 42. The surface 66 forms backing support for the wire 18 and coacts with dog grip 68, as hereinafter described, to affix the wire to the frame 58 when the latter is moved in the wire feed direction. An elongate V-notch 70 formed in the surface 66 assists in affixing the wire 18 to the surface and also serves in guiding the wire along its feed path.

Dog grip 68 which operates to affix the wire 18 to the movable frame is formed as an elongated arm at an intermediate location along which has welded thereto a pivot pin 72 that is pivotally received in an opening (not shown) in the arm 62 of the frame 58. The outer end of the pin 72 is threaded to receive lock nut 74 to retain the dog grip 68 on the frame.

The dog grip 68 is provided at one end with a chisel point 76 formed at the convergence of the surfaces 78 and 80. As shown, the leading surface 78 is cut at a greater rake angle than the trailing surface 80. By means of this construction the chisel point 76 of dog grip 68 is adapted to bitingly engage a wire 18 when the frame 58 is caused to move in the wire feed direction but simply slide along the wire when the frame moves in the opposite direction.

The other end of the arm forming dog grip 68 is provided with a rigidly secured rod 82, one end of which mounts a cam follower 84 which may be rotatable or fixed with respect to the rod. At its other end the rod 82 fixedly mounts a spring retention post 86 adapted to receive one end of a coiled spring 88. The other end of the spring 88 is received on a similar post 90 that is threadedly secured in an opening in plate 92 fixed to the frame 58 and block 64. The spring 88 functions to normally bias the chisel point 76 of dog grip 68 toward the facing surface 66 of the block 64 and into bearing relation with a wire 18 extending therealong in the notch 70.

It will be appreciated that the apparatus thus far described is capable of effecting the feed of wire 18 from the straightener 22 toward the forming die 42 a distance commensurate with the length of stroke of the hammerslide 40. This constitutes the maximum length of feed the mechanism 50 is capable of imparting to the wire 18. Means to selectively regulate the length of feed of the wire 18 with each hammerslide stroke includes a cam body 94 mounted via mounting bracket 96 on the machine 10 intermediate the wire straightener 22 and the entry end of the machine. The body 94 is connected to the bracket 96 by the threaded engagement of nut 98 with the threaded end of a stud 100 that depends from the body. The stud 100 extends through a slot 102 in the bracket 96, which slot is elongated in a direction parallel with the wire feed path thereby enabling the body 94 to be adjustably positioned therealong.

Figure 3:
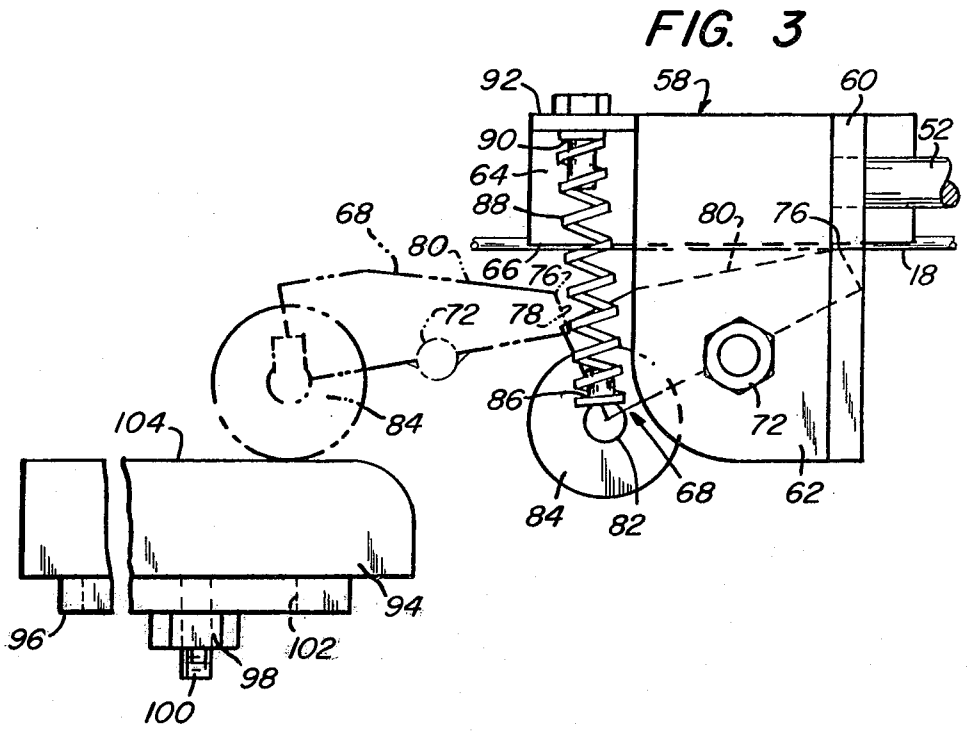
FIG. 3 is a plan view of one portion of the wire feed mechanism of the present invention indicating the movement and operation of the wire feed mechanism.
Figure 4:
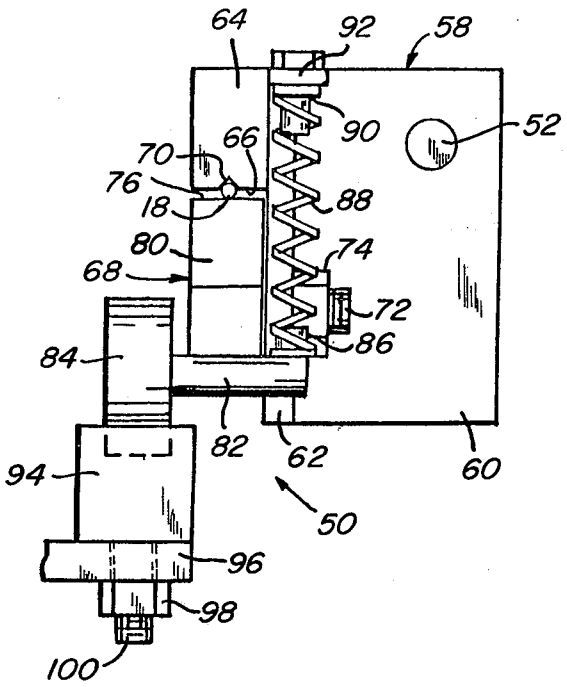
FIG. 4 is a front elevational view of the mechanism shown in FIG. 3.

The upper surface 104 of the cam body 94, as shown best in FIG. 3, is operative to engage the follower 84 on the dog grip 68 to urge the chisel point 76 in opposition to the spring bias away from the surface 66 and wire 18. Thus, the length of wire feed to the forming die can be altered by simply adjusting the position of the cam body 94 on the mounting bracket 96.

The operation of the hereindescribed invention is as follows. With the hammerslide 44 at the forward terminous of its stroke, i.e. coacting with the forming die 42 in its nailheadforming position, the frame 52 of the device 50 is disposed in the position shown in phantom lines in FIG. 3. In this position the follower 84 is caused to engage the surface 104 of cam body 94 thereby urging the dog grip 68 out of engagement with the wire 18. As the hammerslide 44 moves toward its retracted position (to the right in FIG. 2) the follower 84 is moved from the cam body 94 permitting the spring 88 to bias the dog grip 68 counterclockwise about its pivot point and the chisel point 76 into biting engagement with the wire 18 against the surface 66 of block 64. So engaged, the wire 18 is affixed to the frame 52 and caused to move therewith through the remainder of the retracting movement of the hammerslide thereby placing the leading end of the wire in the forming die 42.

Upon reaching the end of its retracting motion, the hammerslide reverses its direction of movement and begins to move toward the forming die 42 (i.e. toward the left in FIG. 2) whereupon, due to the inclination of the trailing surface 80 on dog grip 68 the biting engagement of the chisel point 76 with the wire 18 is released and the dog grip is caused to slide along the wire, the wire being retained in place in the notch 70 of the block 64. Movement of the movable frame 58 of feed device 50 free of the wire 18 is augmented by the fact that, as usual in the nail forming machines of the described type, the wire 18 is grasped by the forming die 42 during this portion of the operating cycle of the machine.

As the frame 58 continues to move to the left, toward its full-forward position, the follower 84 engages the cam body 94 rotating the dog grip 68 clockwise out of contact with the wire 18. The dog grip 68 remains in this position through the remainder of the forward stroke of the hammerslide 44 and continues in this position while the direction of movement of the hammerslide and frame 58 is reversed. When the follower 84 again drops from the cam body 94, the chisel point 76 is returned to biting engagement with the wire 18 and the latter is moved another incremental distance.

To alter the length of feed of the wire 18 in relation to the stroke of the hammerslide 44 the position of the cam body 94 on the mounting bracket 96 need only be changed. Thus to extend the length of feed of the wire the cam body must be moved to the left from the position shown in FIG. 3. To shorten the length of feed the cam body must be moved to the right.

From the foregoing, it will be seen that there is provided a simple, efficient, and easily maintained wire feed mechanism and wire length adjustment apparatus for use with a wire forming machine. The lack of complicated components and the simplification of the moving parts included in the present invention provide for a reliable and easily set up arrangement without the need for cumbersome and wearable components used previously.

While certain changes may be made in the above noted apparatus without departing from the scope of the invention herein involved, it is intended that all matter contained in the above description or shown in the accompanying drawings, shall be interpreted as illustrative and not in a limiting sense.

What is claimed is:

1. Apparatus for feeding wire in predetermined lengths along a wire feed path into the forming die of a nail forming machine in which a continuously operating reciprocating hammerslide is operative to impact the leading end of the wire in the forming die to form a head thereon, said apparatus comprising:

(a) a frame having a wire-backing surface thereon adjacent said wire feed path;

(b) a connecting rod for vertically supporting said frame relative to said wire feed path, said rod being connected between said hammerslide and said frame for imparting reciprocating movement to said frame along said wire feed path between a first position adjacent said forming die and a second position remote therefrom, said connecting rod providing the sole support for said frame;

(c) an elongated dog grip on the opposite side of said wire feed path from said wire-backing surface;

(d) pivot means on said frame connecting with said dog grip intermediate the ends thereof;

(e) spring means between said frame and one end of said dog grip operative to normally bias the other end thereof toward said wire-backing surface;

(f) means on said other end of said dog grip to effect gripping engagement thereof with the wire to be fed as said frame moves toward said second position;

(g) a stationary cam having a cam surface disposed adjacent said second position and operative to engage said one end of said dog grip; and, (h) a cam follower on said one end of said dog grip operative to urge said other end thereof away from said wire backing surface only when said follower engages said cam surface.

2. Apparatus according to claim 1 including means for adjusting the position of said cam surface along said wire feed path for altering the length of wire fed to said forming die.

3. Apparatus according to claim 2 in which said other end of said dog grip contains a chisel point formed of converging surfaces, the one surface in facing relation to the feed direction of the wire having a greater rake than the other surface.

4. Apparatus according to claim 3 including a wire-guide groove coextensive with said wire-backing surface.

* * * * *

UNITED STATES PATENT AND TRADEMARK OFFICE

CERTIFICATE OF CORRECTION

PATENT NO. : 4,342,215

DATED : August 3, 1982

INVENTOR(S) : Ronald L. Van Horn

It is certified that error appears in the above—identified patent and that said Letters Patent is hereby corrected as shown below:

On the front page, under "Assignee:", change the address of the assignee from "Pittsburgh, California" to -- Pittsburgh, Pennsylvania --.

Column 2, line 16, change "for" to -- of --.

Signed and Sealed this

Fifth Day of October 198

[SEAL]

*Attest:*

GERALD J. MOSSINGHOFF

*Attesting Officer*

*Commissioner of Patents and Trademarks*